US006676040B2

(12) United States Patent
Park

(10) Patent No.: US 6,676,040 B2
(45) Date of Patent: Jan. 13, 2004

(54) VARIABLE SWIRL TYPE GDI INJECTOR

(75) Inventor: Jong-Bum Park, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 219 days.

(21) Appl. No.: 09/989,491

(22) Filed: Nov. 21, 2001

(65) Prior Publication Data

US 2002/0084354 A1 Jul. 4, 2002

(30) Foreign Application Priority Data

Dec. 30, 2000 (KR) ..... 2000-86902

(51) Int. Cl.[7] ..... B05B 1/34; F02M 61/00
(52) U.S. Cl. ..... 239/463; 239/533.12; 239/484
(58) Field of Search ..... 239/463, 533.12, 239/484, 483, 473, 475, 490, 533.2, 533.3, 585.5, 390, 391, 394, 89, 91; 251/129.15, 129.21, 127

(56) References Cited

U.S. PATENT DOCUMENTS 5,207,384 A * 5/1993 Horsting ..... 239/463
6,206,304 B1 * 3/2001 Koseki et al. ..... 239/533.12

* cited by examiner

*Primary Examiner*—Michael Mar
*Assistant Examiner*—Darren Gorman
(74) *Attorney, Agent, or Firm*—Birch, Stewart, Kolasch & Birch, LLP

(57) ABSTRACT

The present invention provides a GDI injector of a vehicle engine that can change the level of swirl motion and make it possible to increase engine output and fuel mileage, comprising a nozzle body having an opening along its longitudinal axis, a fuel inlet member, a cylindrically-shaped needle valve being centrally located within the opening of the nozzle body, and a swirl generator, the swirl generator comprising: an inner case having a cylindrically-shaped body and a plurality of equally and angularly spaced lobes, the inner case being coupled to the needle; an outer case having a cylindrically-shaped body and a plurality of equally and angularly spaced grooves, the outer case being fixedly attached to the nozzle body; and an inner case rotator.

4 Claims, 2 Drawing Sheets

VARIABLE SWIRL TYPE GDI INJECTOR

CROSS-REFERENCE TO RELATED APPLICATION

This application claims priority of Korea patent Application No. 10-2000-0086902, filed on Dec. 30, 2000.

BACKGROUND OF THE INVENTION (a) Field of the Invention

The present invention relates to a fuel injector of a vehicle engine, and more particularly, to a high-pressure, direct-injection fuel injector having a swirl generator for imparting a desired level of swirling motion to the fuel as it exits the injector.

(b) Description of the Related Art

Generally, because a fuel injector of a GDI (Gasoline Direct Injection) engine injects fuel into a combustion chamber directly, it operates under high pressure. Also, the fuel injector of the GDI engine (hereinafter called a GDI injector) is required to inject a specific amount of fuel for a specific period. Moreover, in the process of injecting fuel there are many parameters to be considered, such as injection range, injection angle, size of fuel droplets, evaporation level and the like, and because the fuel injector is installed in the combustion chamber it has restrictions of space and temperature. Recently, several types of GDI injectors have been proposed, and among them a swirl type injector, which has a swirl generator, is widely adopted. The swirl generator imparts a swirling motion to the fuel as it exits the injector. Therefore, fuel dispersibility increases and fuel is prevented from being directly sprayed against a piston or a cylinder liner, and the fuel is well mixed with air.

But in the GDI engine it becomes necessary to change a level of a swirl flow component according to driving conditions. That is, when stratification combustion in the latter part of compression is performed at a low load range, a high level of swirl motion is required because the injection range should be relatively small, and fuel should be mixed with air quickly to get a suitable air-fuel mixture around a spark plug in a small combustion volume. On the other hand, when in a high load range, fuel is injected at an intake stroke or an early state of compression, and a low level of swirl motion is required because there is a large volume for burning and relatively sufficient time for mixing.

A conventional GDI injector is provided with a swirl generator around a needle being located in a nozzle tip. If the needle is operated such that a fuel passageway is formed, fuel passing through an inclined passageway of the swirl generator has a constant level of swirl motion.

Because the conventional GDI injector has a constant level of swirl motion under constant injection pressure, the conventional GDI injector has the same injection range and air-fuel mixing level in both uniform combustion and stratification combustion, and therefore optimal driving control is almost impossible.

SUMMARY OF THE INVENTION

The present invention has been made in an effort to solve the above problems. It is an object of the present invention to provide a GDI fuel injector having a swirl generator around the needle of the nozzle tip, which can change a level of a swirl motion component of injected fuel.

To achieve the above object, a GDI fuel injector has a nozzle body, a needle member centrally located within a nozzle body such that a fuel passageway is formed between the needle and the nozzle body, and a swirl generator, the swirl generator comprising:

an inner case having a cylindrically-shaped body having an opening from the upper end to the bottom end along its longitudinal axis, and several equally and angularly spaced lobes;

an outer case having a cylindrically-shaped body having an opening from the upper end to the bottom end along its longitudinal axis, and several equally and angularly spaced grooves 36 inside the body 34, of such size and shape so as to receive the lobes of the inner case; and an inner case rotator, one end of which is fixedly connected to the inner case such that the inner case can be axially rotated by axially rotating the inner case rotator, the other end being provided with a grip.

DETAILED DESCRIPTION OF THE PREFERRED EMBODIMENTS

Hereinafter, a preferred embodiment of the present invention will be described in detail with reference to the accompanying drawings.

Figure 1:
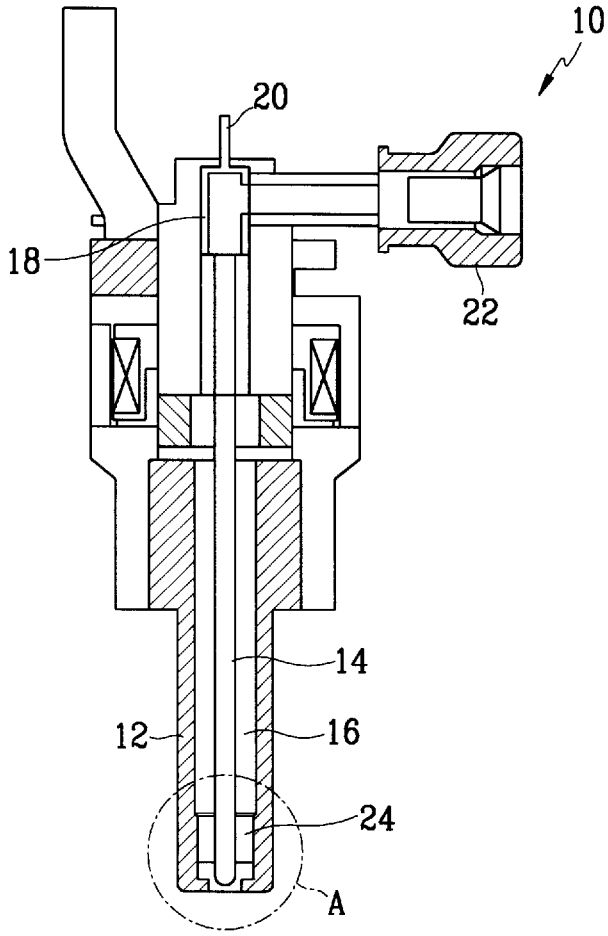
FIG. 1 is a cross-sectional view of an injector provided with a swirl generator according to the present invention.
Figure 2:
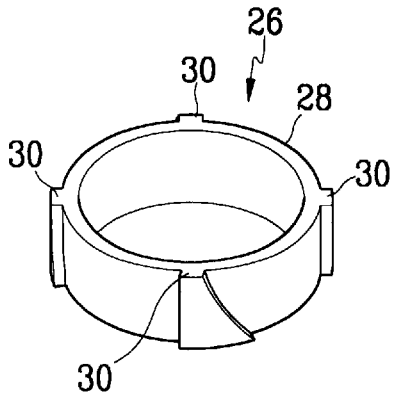
FIG. 2 is a perspective view of an inner case of the swirl generator according to the present invention.
Figure 3:
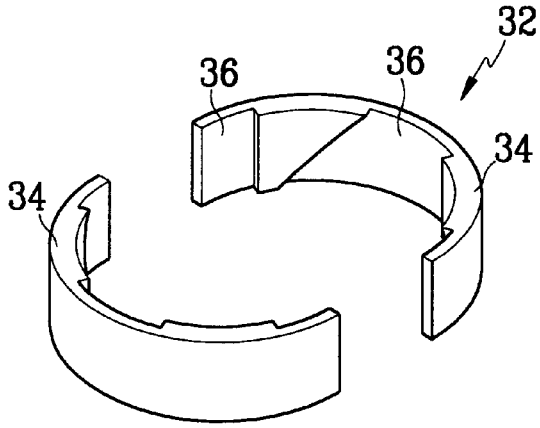
FIG. 3 is a perspective view of an outer case of the swirl generator according to the present invention.
Figure 4:
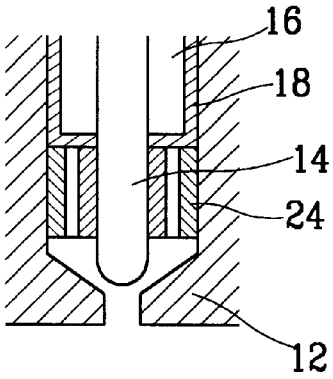
FIG. 4 is a sectional view of outside parts of region "A" of FIG. 1.

FIG. 1 is a cross-sectional view of an injector provided with a swirl generator according to the present invention, FIG. 2 is a perspective view of an inner case of the swirl generator according to the present invention, FIG. 3 is a perspective view of an outer case of the swirl generator according to the present invention, and FIG. 4 is a sectional view of outside parts of region "A" of FIG. 1.

As shown in FIG. 1, the injector has a fuel inlet member 22, a nozzle body 12 having an opening along a longitudinal axis, and a cylindrically-shaped needle valve 14 that is centrally located within the opening of the nozzle body 12 and reciprocally moves between a closed position and one of a plurality of open positions, and a swirl generator 24. There is a space between the circumference of the needle valve 14 and the nozzle body 12, the space acting as a fuel passageway 16, and the swirl generator 24 is disposed in a lower part of the fuel passageway.

The swirl generator 24 comprises a moveable inner case 26 secured to the needle valve 14, a fixed outer case 32 fabricated to receive the inner case 26, and an inner case rotator 18. It is through the cooperation of these two cases 26 and 32 that the fuel passing through the injector is imparted with a tangential swirl force resulting in a swirl pattern.

The inner case 26, as shown in FIG. 2, has a cylindrically-shaped body 28 having an opening from the upper end to the bottom end along its longitudinal axis, and several equally and angularly spaced lobes 30. The width of the lobes gradually increases at an increasing rate in a downward direction, and therefore the shape of the lobes becomes generally a right triangle with a concave hypotenuse.

The needle valve 14, as shown in FIG. 1, is inserted into the opening of the inner case 26. The inner case 26 is secured to the needle valve 14 and therefore reciprocates and rotates with the needle. In order to prevent the inner case from rotating on the needle, the inner case is fabricated such that the radius of the opening of the inner case is identical to the outer radius of the needle, and furthermore, when the needle valve is inserted into the opening of the inner case in the process of manufacture, an adhesive material is applied between the needle valve and the inner case.

The outer case 32, as shown in FIG. 3, has a cylindrically-shaped body 34 having an opening from the upper end to the bottom end along its longitudinal axis, and it has several equally and angularly spaced grooves 36 inside the body 34, of such size and shape so as to receive the lobes of the inner case 26, the number of which is equal to that of the lobes of the inner case.

The width of the grooves gradually increases in a downward direction, and therefore the shape of the grooves becomes generally trapezoidal. The area of the grooves 36 is greater than that of the lobes 30, but the shape of the grooves 36 generally matches that of the lobes 30.

The outer case 32 is disposed outside of the inner case 26 such that the lobes of the inner case are located in the grooves of the outer case, and therefore inclined passageways are formed between inclined edges of the lobes of the inner case and inclined edges of the grooves of the outer case.

The outer diameter of the outer case 32 is identical to the inner diameter of the nozzle body, and the outer case is forced into the nozzle body 12. The outer case 32, as shown in FIG. 3, can be manufactured in two parts such that the outer case can be easily inserted into the nozzle body.

The inner case rotator 18 is located inside the nozzle body, one end of which is fixedly connected to the inner case 26, the other end being provided with a grip 20. By rotating the grip 20, the inner case 26 can be rotated in a clockwise or a counterclockwise direction such that the inclined fuel passageways can be changed, hence the level of swirl motion can be changed.

As shown in FIG. 1, the needle valve 14 is coaxially disposed within the inner case rotator 18, and the grip 20 protrudes from an upper end of the nozzle body, and the fuel inlet member 22 is connected to the upper end of the nozzle body at an angle such that the grip is accessible.

Consequently, when fuel passes the fuel inlet member 22 of the injector 10 and the nozzle body and is injected into a combustion chamber, fuel passes through the inclined passageways formed between the outer case 32 and the inner case 26 of the swirl generator 24 that is installed in the lower part of the fuel passageway 16. Above the swirl generator 24 fuel flows in a straight line, but as it passes through the swirl generator 24 it acquires a high level of swirl motion because it passes through the inclined passageways.

After fuel passes through the swirl generator, it is injected into the combustion chamber with a high level of swirl motion.

If the inner case 26 is rotated by rotating the grip 20, the shape of the passageways formed between the lobes 30 of the inner case 26 and the grooves 36 of the outer case 32 is changed. Therefore, if the inner case 26 is rotated, the level of swirl motion of injected fuel is changed.

If the inner case 26 is rotated clockwise (being seen from the top) such that the vertical surfaces of the lobes 30 and the grooves 36 contact each other, inclined passageways are formed, and thus injected fuel has a high level of swirl motion.

On the other hand, if the inner case 26 is rotated counterclockwise such that the inclined surfaces of the lobes 30 and the grooves 36 contact each other when the needle valve is open, straight passageways are formed, and thus injected fuel doesn't swirl.

Furthermore, by regulating an angle of the inclined surfaces of the lobes 30 and the grooves 36, a level of the swirl motion can be changed, and by changing direction of the inclination, swirl direction can be changed.

The conventional GDI injector has a constant level of swirl motion under constant injection pressure, and the same injection range and air-fuel mixing level in both uniform combustion and stratification combustion, and therefore optimal driving control is almost impossible. The swirl generator according to the present invention, by rotating the inner case, can change the level of the swirl motion and therefore fuel can be optimally injected in a GDI engine such that engine output and fuel mileage can be increased.

While the present invention has been described in detail with reference to the preferred embodiment, those skilled in the art will appreciate that various modifications and substitutions can be made thereto without departing from the spirit and scope of the present invention as set forth in the appended claims.

What is claimed is:

1. A GDI injector of a vehicle engine including a nozzle body having an opening along its longitudinal axis, a cylindrically-shaped needle valve being centrally located within the opening of the nozzle body, a fuel inlet member, and a swirl generator, wherein the swirl generator comprises:

an inner case having a cylindrically-shaped body and a plurality of equally and angularly spaced lobes, the inner case being coupled to the needle valve such that the inner case does not rotate on the needle valve;

an outer case having a cylindrically-shaped body and a plurality of equally and angularly spaced grooves that are fabricated to define a fuel passageway in cooperation with the lobes of the inner case, the outer case being fixedly attached to the nozzle body; and an inner case rotator for adjusting the level of swirl motion of the injected fuel by axially rotating the inner case relative to the outer case.

2. The GDI injector of claim 1 wherein a width of the lobes gradually increases at an increasing rate in a downward direction such that the shape of the lobes becomes generally a right triangle with a concave hypotenuse, and the width of the grooves gradually increases in a downward direction such that the shape of the grooves becomes generally trapezoidal.

3. The GDI injector of claim 1 wherein the outer case is divided into two parts along a centerline.

4. The GDI injector of claim 1 wherein the needle valve is coaxially disposed within the inner case rotator, and one end of the inner case rotator is fixedly connected to the inner case, the other end being provided with a grip.

* * * * *